US006699092B1

(12) United States Patent
Cimerman et al.

(10) Patent No.: US 6,699,092 B1
(45) Date of Patent: Mar. 2, 2004

(54) TOY AQUARIUM AND METHOD OF USING THE SAME

(75) Inventors: Christopher D. Cimerman, Clarence Center, NY (US); Robert W. Jourdian, East Aurora, NY (US); Robert W. Salmon, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/228,255

(22) Filed: Aug. 27, 2002

(51) Int. Cl.[7] ..... A63H 23/00

(52) U.S. Cl. ..... 446/153; 446/74; 446/267

(58) Field of Search ..... 446/153, 154, 446/197, 74, 267; 119/245, 253; 273/457, 448, 456, 447; 40/126, 406, 410

(56) References Cited

U.S. PATENT DOCUMENTS

| | | | | |
|---|---|---|---|---|
| 925,209 | A | | 6/1909 | Livermore |
| 1,838,215 | A | | 12/1931 | De Clairmont |
| 2,773,175 | A | | 12/1956 | Levy et al. |
| 3,239,956 | A | | 3/1966 | Canonica, Jr. |
| 3,271,897 | A | | 9/1966 | Gelinas |
| 3,370,366 | A | | 2/1968 | Van Zanten |
| 3,425,157 | A | | 2/1969 | Hartsock |
| 3,563,204 | A | | 2/1971 | Szilagyi |
| 3,650,056 | A | | 3/1972 | Walton |
| 3,975,845 | A | | 8/1976 | Mellard |
| 4,032,141 | A | | 6/1977 | Tanimura |
| 4,223,471 | A | | 9/1980 | Greenberg |
| 4,362,299 | A | | 12/1982 | Suzuki |
| 4,382,597 | A | | 5/1983 | Minami |
| 4,490,931 | A | | 1/1985 | Fleemin |
| 4,578,044 | A | | 3/1986 | Saitoh |
| 4,588,618 | A | | 5/1986 | Wolfe |
| D287,110 | S | | 12/1986 | Grun |
| 4,691,459 | A | | 9/1987 | Butler |
| 4,778,429 | A | | 10/1988 | Todokoro |
| 4,869,005 | A | | 9/1989 | Valentino |
| 4,923,429 | A | | 5/1990 | Lewis |
| 4,939,859 | A | | 7/1990 | Bradt |
| 4,961,276 | A | | 10/1990 | Lin |
| 4,990,118 | A | | 2/1991 | Shiina |
| 5,050,876 | A | | 9/1991 | Chuang |
| 5,092,065 | A | | 3/1992 | Teng |
| 5,098,111 | A | * | 3/1992 | Kashimoto ..... 273/457 |
| 5,189,821 | A | | 3/1993 | Lee |
| 5,301,444 | A | | 4/1994 | Horiuchi |
| 5,313,727 | A | | 5/1994 | Murray, Jr. |
| 5,442,869 | A | * | 8/1995 | McDarren et al. ..... 40/406 |
| 5,463,826 | A | | 11/1995 | Horiuchi |
| 5,483,764 | A | | 1/1996 | Lin |
| 5,566,491 | A | | 10/1996 | Phillips |
| 5,603,994 | A | | 2/1997 | Su |
| 5,609,341 | A | * | 3/1997 | Chuang ..... 273/448 |
| 5,666,750 | A | * | 9/1997 | Segan et al. ..... 40/410 |
| 5,685,096 | A | | 11/1997 | Horiuchi |
| 5,706,594 | A | * | 1/1998 | Lin ..... 40/406 |
| D400,619 | S | | 11/1998 | Schultheis et al. |
| 5,857,277 | A | * | 1/1999 | Mayze ..... 40/410 |
| 6,036,570 | A | * | 3/2000 | Nadel ..... 446/74 |
| 6,062,938 | A | | 5/2000 | Meng-Suen |
| 6,131,318 | A | | 10/2000 | Hsieh |
| 6,148,770 | A | | 11/2000 | Lin |
| 6,165,036 | A | | 12/2000 | Hino et al. |
| 6,334,270 | B1 | * | 1/2002 | Ko ..... 40/406 |

FOREIGN PATENT DOCUMENTS

| | | |
|---|---|---|
| DE | 3618952 A1 | 12/1987 |
| GB | 599870 | 3/1948 |

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

A toy aquarium includes a container configured to contain a liquid and a drive mechanism operably coupled to toy characters to impart motion to the toy characters.

20 Claims, 9 Drawing Sheets

TOY AQUARIUM AND METHOD OF USING THE SAME

BACKGROUND OF THE INVENTION

This invention relates to a toy aquarium, and, in particular, to a toy aquarium and a method of using the toy aquarium.

Children enjoy conventional toys that have movable parts. In particular, children are typically interested in toys that include moving toy characters. Some conventional toys, such as toy aquariums, are related to aquatic environments.

A need exists for a new toy aquarium that simulates an aquatic environment. A need also exists for a toy aquarium that includes a drive mechanism that easily and simply imparts motion to a toy character.

SUMMARY OF THE INVENTION

A toy aquarium includes a housing with a tank and a toy character movably mounted proximate to the tank. In one embodiment, the tank is a container configured to contain a liquid. The toy aquarium includes a compartment located next to the tank. In one embodiment, the toy character is movably mounted in the compartment. In an alternative embodiment, multiple toy characters are movably mounted in the compartment.

The toy aquarium includes a drive mechanism that is operably coupled to the toy character to move the toy character. In one embodiment, the toy aquarium includes a bubble generating mechanism that is configured to generate bubbles in the liquid in the tank. In another embodiment, the toy aquarium includes a light generating mechanism that is configured to transmit light into the tank.

DETAILED DESCRIPTION OF THE INVENTION

A toy aquarium includes a housing with a tank and a toy character movably mounted proximate to the tank. In one embodiment, the tank is a container configured to contain a liquid. The toy aquarium includes a compartment located next to the tank. In one embodiment, the toy character is movably mounted in the compartment. In an alternative embodiment, multiple toy characters are movably mounted in the compartment.

The toy aquarium includes a drive mechanism that is operably coupled to the toy character to move the toy character. In one embodiment, the toy aquarium includes a bubble generating mechanism that is configured to generate bubbles in the liquid in the tank. In another embodiment, the toy aquarium includes a light generating mechanism that is configured to transmit light into the tank.

Figure 1:
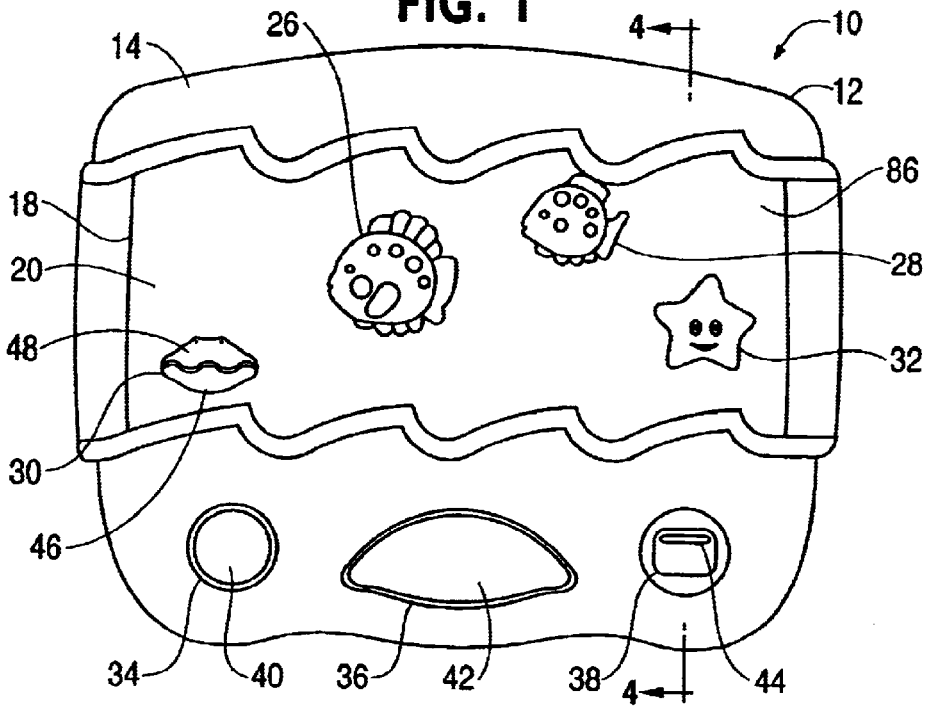
FIG. 1 illustrates a front view of an embodiment of a toy aquarium in accordance with the present invention.
Figure 2:
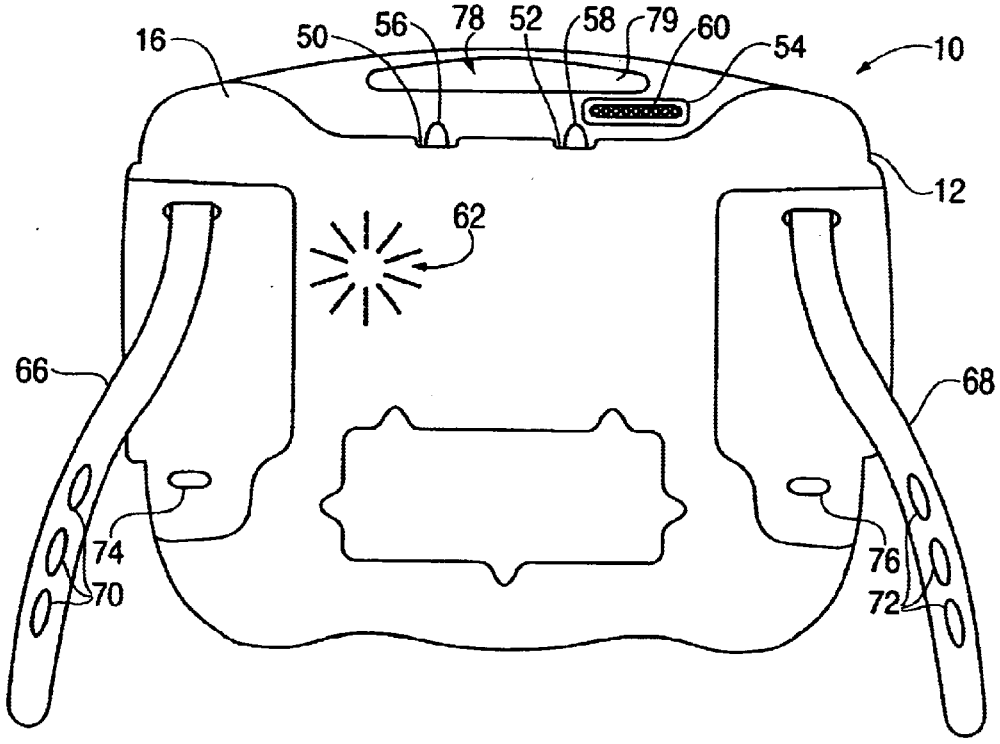
FIG. 2 illustrates a rear view of the toy aquarium of FIG. 1.
Figure 3:
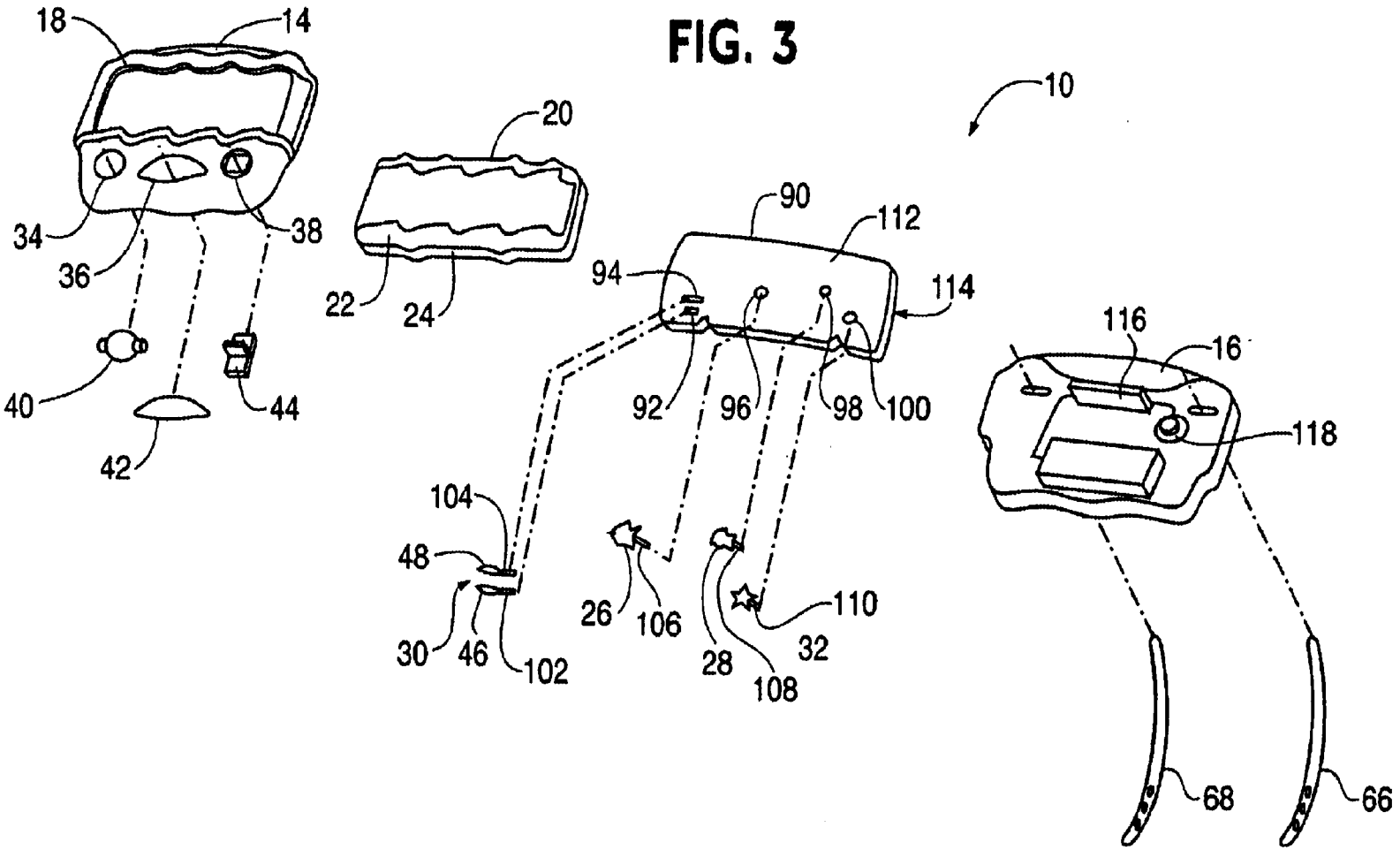
FIG. 3 illustrates an exploded perspective view of some of the components of the toy aquarium of FIG. 1.

An embodiment of a toy aquarium in accordance with the present invention is illustrated in FIGS. 1–3. In the illustrated embodiment, the toy aquarium 10 includes a housing 12 with a front portion 14 and a rear portion 16. The front portion 14 and the rear portion 16 can be coupled together by any type of conventional fasteners, such as bolts or screws. The front portion 14 includes several walls that define an interior region therebetween. Similarly, the rear portion 16 includes several walls that define an interior region therebetween.

In the illustrated embodiment, the toy aquarium 10 includes a container 20 that includes several walls that form an interior cavity or area therebetween. The container 20 is configured to contain a fluid, which is illustrated as 86 in FIG. 1. The fluid in the container 20 can be any type of liquid, such as water or a mixture of water and propylene glycol. In the illustrated embodiment, the walls of the container 20 are formed of a transparent material, such as a transparent plastic. The container 20 is coupled to an interior surface of the housing 12 using conventional fasteners.

As illustrated in FIG. 1, the toy aquarium 10 includes several toy characters 26, 28, 30, and 32. In the illustrated embodiment, the toy characters 26, 28, 30, and 32 are located within housing 12 and behind the container 20. The placement of the toy characters 26, 28, 30, and 32 behind the container 20 creates the appearance that the toy characters 26, 28, 30, and 32 are disposed within the container 20 when the toy aquarium 10 is viewed from the front.

In the illustrated embodiment, toy characters 26, 28, 30, and 32 resemble aquatic characters. Toy characters 26 and 28 resemble fish and toy character 32 resembles a starfish. Toy character 30 resembles a clam and includes a lower portion 46 and an upper portion 48 that resemble a lower shell and an upper shell of a clam, respectively.

Returning to the housing 12, the front portion 14 of the housing 12 includes an opening 18. When the components of the toy aquarium 10 are assembled, the container 20 is aligned with the opening 18 to allow a user to view the contents of the toy aquarium 10.

As illustrated in FIG. 1, the housing 12 includes apertures 34 and 38 formed in the front portion 14. The toy aquarium 10 includes actuators 40 and 44 operably disposed in the apertures 34 and 38, respectively. The actuators 40 and 44 are operably coupled to toy characters 30 and 32, respectively. When a user engages actuator 40 or 44, the corresponding toy character 30 or 32 moves.

The front portion 14 of the housing 12 also includes an aperture 36 in which an activation button 42 is operably disposed. The operation of the actuators 40 and 44 and the activation button 42 is discussed in greater detail below.

As illustrated in FIG. 2, the rear portion 16 of the housing 12 includes apertures or recesses 50, 52, and 54 in which a mode selection switch 56, an audio selection button 58, and a volume adjustment dial 60 are located. The operation of the mode selection switch 56, the audio selection button 58, and the volume adjustment dial 60 is discussed in greater detail below. The rear portion 16 also includes several openings 62 through which audio outputs from a transducer 118, such as a speaker (see FIG. 3), can be heard.

In the illustrated embodiment, the toy aquarium 10 includes conventional straps 66 and 68 that are mounted to the housing 12 and configured to secure the toy aquarium 10 to a support structure, such as an infant crib. The rear portion 16 includes extensions 74 and 76 that can be inserted into openings 70 and 72 formed in straps 66 and 68.

As illustrated in FIG. 2, the toy aquarium 10 includes a handle region 78. The handle region 78 is configured to facilitate carrying of the toy aquarium 10 by a user. In the illustrated embodiment, the handle region 78 includes a recess 79 formed in the rear portion 16. In an alternative embodiment, the handle region 78 may include a separate member that is spaced apart from and coupled to the housing 12.

An embodiment of several components of the toy aquarium 10 is illustrated in FIG. 3. In the illustrated embodiment, the container 20 is coupled to the front portion 14 of the housing 12. The container 20 includes a transparent front wall or region 22 and a transparent rear wall or region 24 that is coupled to the front wall 22 using conventional fasteners.

The front wall 22 is located next to the front portion 14. The front wall 22 includes several transparent side walls 23 and the rear wall 24 includes several transparent side walls 25. When the front wall 22 and the rear wall 24 are placed into contact with each other, walls 22, 23, 24, and 25 collectively define a compartment therebetween (see FIG. 4).

Figure 4:
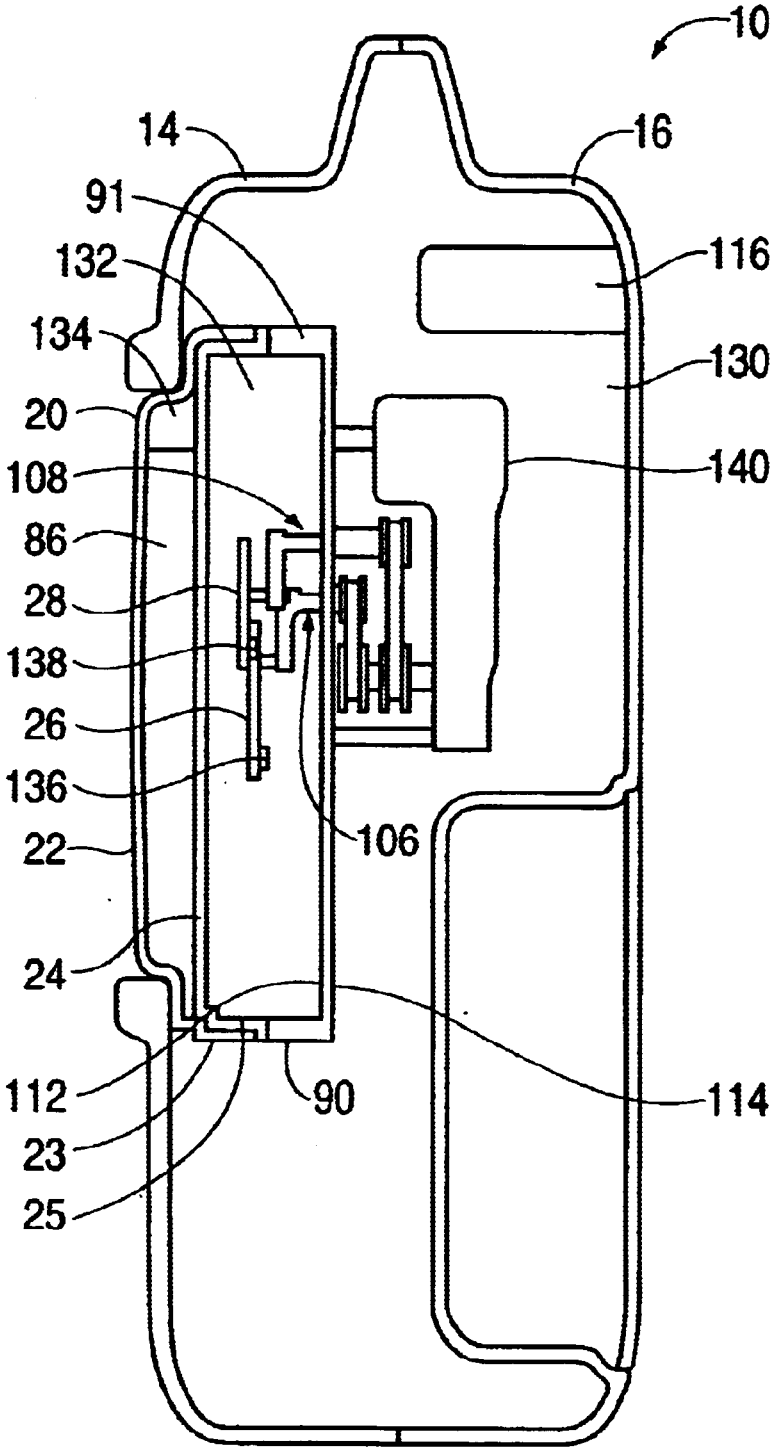
FIG. 4 illustrates a cross-sectional view of some of the components of the toy aquarium of FIG. 1, taken along line 4—4 of FIG. 1.

Referring to FIGS. 3 and 4, the toy aquarium 10 includes a plate 90 that is located proximate to the container 20 within the housing 12. The plate 90 includes several side walls 91 extending from the plate 90 that define a compartment 132 between the plate 90 and the container 20. In the illustrated embodiment, the plate 90 is coupled to the container 20 using conventional fasteners. In alternative embodiments, the plate 90 may be coupled to the housing 12 or formed integrally with the housing 12.

The plate 90 has a front surface 112 and a rear surface 114. Various types of indicia, such as indicia related to an aquatic environment, may be located on the front surface 112. In an alternative embodiment, indicia may be formed on a display element (not shown), such as a sticker or a paper, and the display element may be disposed on the front surface 112. As illustrated in FIG. 3, the plate 90 includes several apertures 92, 94, 96, 98, and 100, the operation of which is discussed in greater detail below.

As illustrated in FIG. 3, the toy characters 26, 28, 30, and 32 are located proximate to the front surface 112 of the plate 90 and the rear wall 24 of the container 20. In particular, toy characters 26, 28, 30, and 32 are aligned with apertures 92, 94, 96, 98, and 100 and movably mounted to the plate 90.

In the illustrated embodiment, the toy aquarium 10 includes drive elements 106 and 108, respectively, that are coupled to rear surfaces of toy characters 26 and 28. The drive elements 106 and 108 extend through plate apertures 96 and 98, respectively.

Each of the drive elements 106 and 108 are coupled to a drive mechanism 140 (see FIG. 4). The drive mechanism 140 is located proximate to the rear surface 114 of the plate 90. In the illustrated embodiment, the drive mechanism 140 is configured to impart rotational motion to drive elements 106 and 108. The drive elements 106 and 108 are configured to impart motion to toy characters 26 and 28. The operation of drive elements 106 and 108 and drive mechanism 140 is discussed in greater detail below with respect to FIGS. 4–6.

Regarding the movement of toy character 30, the lower portion 46 and the upper portion 48 of toy character 30 include rearwardly extending elements or extensions 102 and 104, respectively. As illustrated in FIG. 3, extensions 102 and 104 extend through plate apertures 92 and 94, respectively. Extension 102 is fixedly coupled to plate 90 and extension 104 is rotatably coupled to plate 90. Extension 104 is operably coupled to actuator 40, such that user engagement of actuator 40 causes movement of the upper portion 48. The operation of actuator 40 is discussed in greater detail below with respect to FIG. 9.

Regarding the movement of toy character 32, the toy aquarium 10 also includes a drive element 110 that is coupled to toy character 32. The drive element 110 extends through aperture 100 of the plate 90 and is operably coupled to actuator 44. User engagement of actuator 44 causes movement of toy character 32 via drive element 110. The operation of actuator 44 and drive element 110 is discussed in greater detail below with respect to FIG. 8.

In the illustrated embodiment, the toy aquarium 10 includes a control unit 116 located in housing 12. The control unit 116 is configured to receive various user inputs and to coordinate the generation of outputs in response to those inputs. Some of the inputs include actuation of activation button 42, the mode selection switch 56, the audio selection button 58, and the volume adjustment dial 60. In response to any of these inputs, the control unit 116 causes operation of the sound generating mechanism, the drive mechanism 140, a bubble generating mechanism 340, and/or a light generating mechanism 336.

In the illustrated embodiment, the control unit 116 includes a memory and a processor (not shown). The memory can be, for example, any conventional memory, such as a disk drive, cartridge, or solid state memory, in which various audio outputs, such as music, selections, sound effects, and speech, can be stored. The processor can be, for example, any conventional processor, such as a conventional integrated circuit.

The sound generating mechanism can include any conventional speaker or other suitable audio transducer. In the illustrated embodiment, the control unit 116 is connected to the various components of the toy aquarium by any conventional wired or wireless connections.

An embodiment of several components of the toy aquarium 10 is illustrated in FIG. 4. FIG. 4 is a cross-sectional view of the toy aquarium 10, taken along line 4—4 of FIG. 1.

As illustrated in FIG. 4, the toy aquarium 10 includes several compartments 130, 132, and 134. In the illustrated embodiment, compartments 130, 132, and 134 are referred to as a drive compartment 130, a character compartment 132, and a liquid compartment 134, respectively. The drive compartment 130 is formed by the inner surfaces of the rear portion 16, the front portion 14, and the internal components of the toy aquarium 10. The character compartment 132 is formed by the front surface 112 of the plate 90 and the rear wall 24 of the container 20. The liquid compartment 134 is also referred to as the container or tank 20.

As illustrated in FIG. 4, the drive mechanism 140 is disposed in the drive compartment 130. The drive mechanism 140 is mounted on the rear surface 114 of the plate 90 using conventional fasteners. The drive mechanism 140 is operatively coupled to the ends of the drive elements 106 and 108 that are disposed in the drive compartment 130. The drive mechanism 140 is configured to rotate the drive elements 106 and 108 about their longitudinal axes.

In the illustrated embodiment, the character compartment 132 is located between the drive compartment 130 and the liquid compartment 134. As illustrated in FIG. 4, toy characters 26 and 28 are disposed in the character compartment 132. While not illustrated in FIG. 4, toy characters 30 and 32 are also located in character compartment 132.

Toy characters 26 and 28 are rotatably coupled to the ends of the drive elements 106 and 108 that are located in the character compartment 132. Rotation of drive elements 106 and 108 causes movement of toy characters 26 and 28.

In the illustrated embodiment, toy characters 26 and 28 include weights 136 and 138, respectively, coupled to the rear surfaces of the toy characters. The weights 136 and 138 cause the characters 26 and 28 to retain a substantially horizontal orientation as drive elements 106 and 108 rotate and toy characters 26 and 28 move.

The liquid compartment 134 is a tank that is configured to contain a liquid. As illustrated in FIG. 4, the liquid compartment 134 is substantially filled with the liquid 86. The liquid compartment 134 also includes a fluid, such as air, in addition to the liquid 86. The function of the air is discussed in greater detail below.

Figure 5:
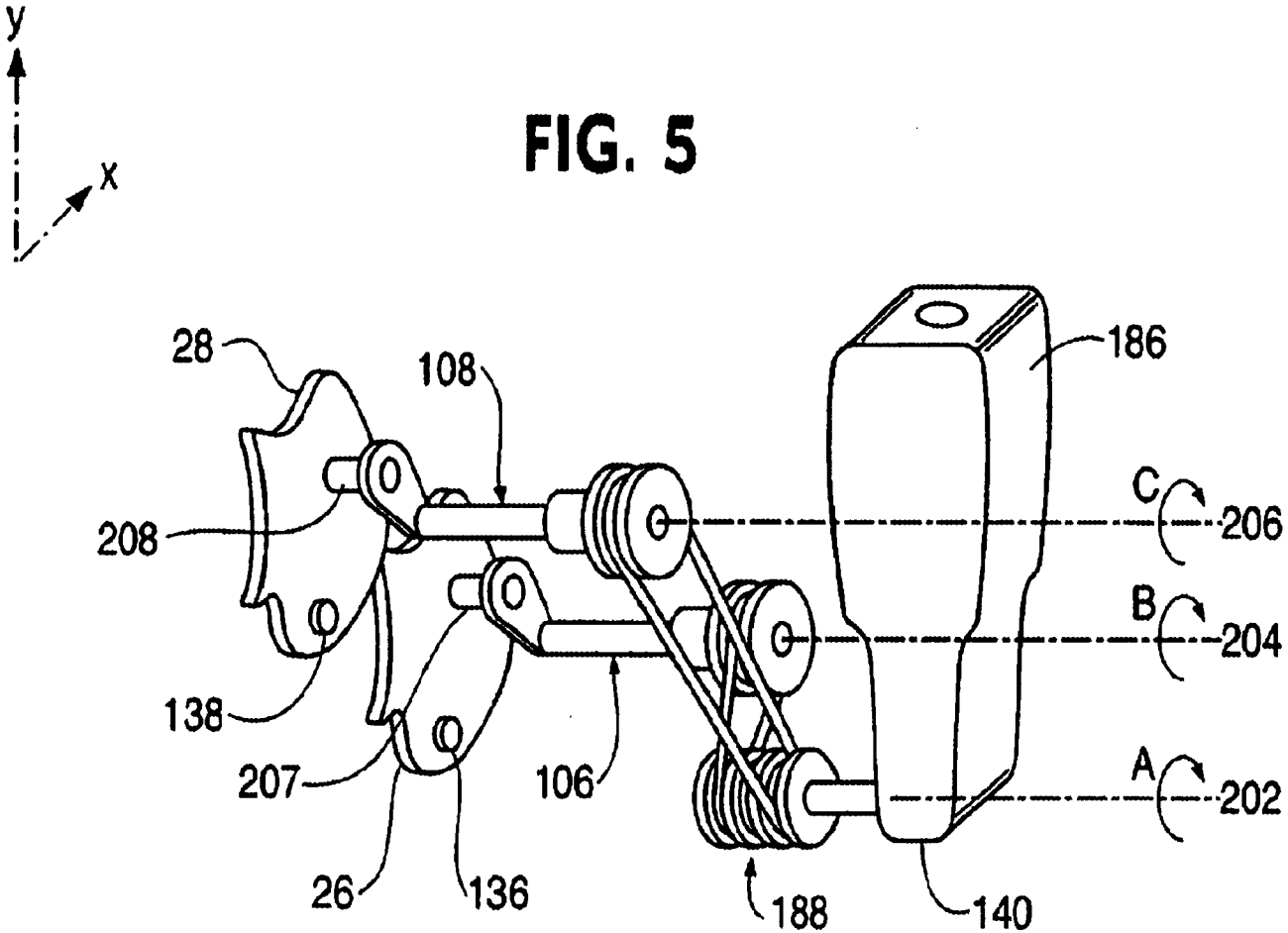
FIG. 5 illustrates an assembled perspective view of the operative relationship of toy characters, drive elements, and a drive mechanism of the toy aquarium of FIG. 1.
Figure 6:
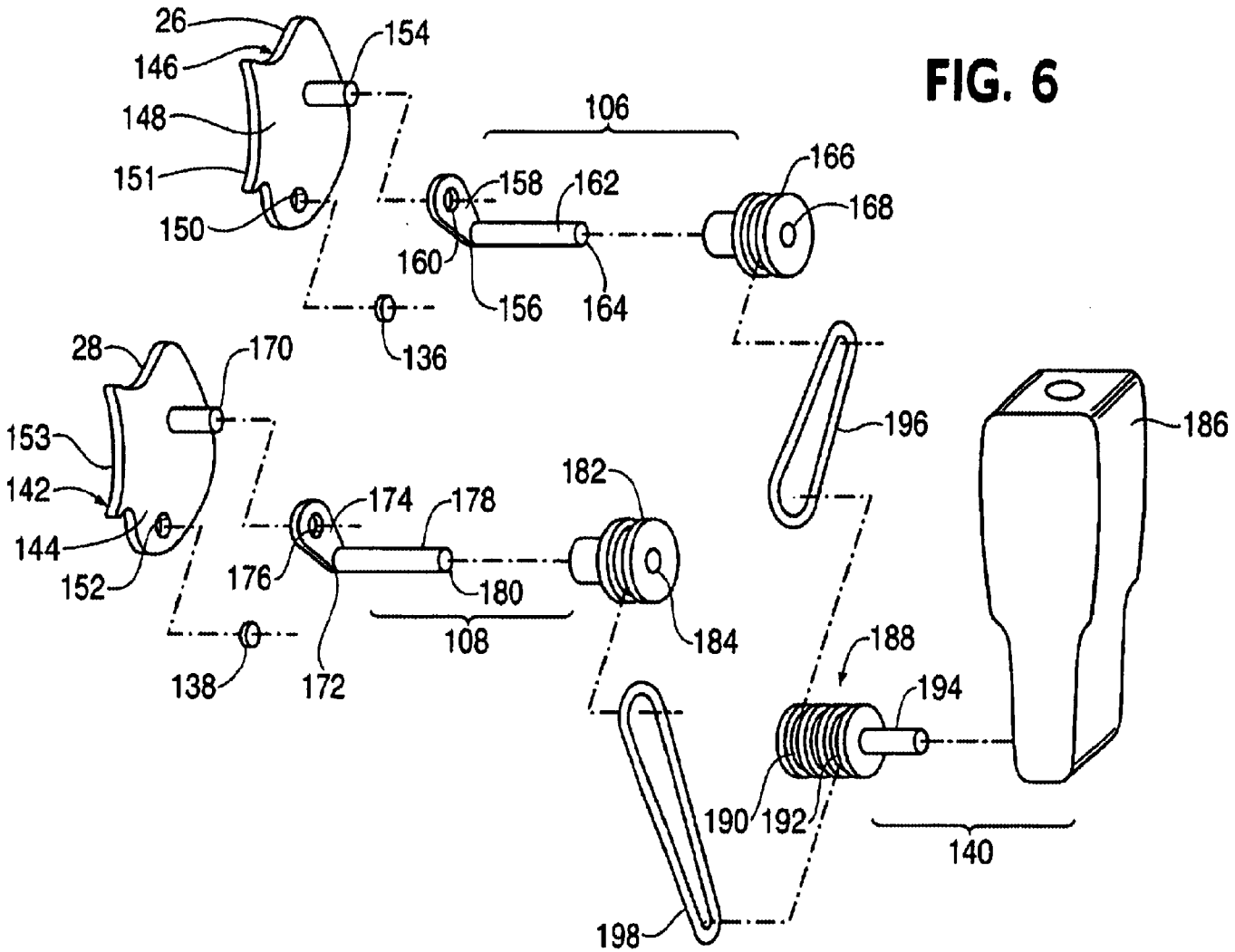
FIG. 6 illustrates an exploded perspective view of the components of FIG. 5.

Next, the operative relationship of toy characters 26 and 28, drive elements 106 and 108, and the drive mechanism 140 is discussed with reference to FIGS. 5 and 6. FIGS. 5 and 6 are rear perspective views of some of the internal components of the toy aquarium 10.

In the illustrated embodiment, the drive mechanism 140 includes a motor 186 and a drive coupling 188 that is coupled to the motor 186. The motor 186 is configured to rotate the drive coupling 188 along the direction of arrow "A" about axis 202 as illustrated in FIG. 5. The drive coupling 188 includes pulleys 190 and 192 that are coupled to a shaft 194 that is rotatably coupled to the motor 186. In an alternative embodiment, the motor 186 can be a reversible motor that can rotate the drive coupling 188 in the opposite direction about axis 202.

In the illustrated embodiment, drive element 106 includes a shaft 162 with a coupler 156 mounted on one end and a pulley 166 mounted on its opposite end. The shaft 162, coupler 156, and pulley 166 rotate simultaneously about axis 204 (see FIG. 5).

Similarly, drive element 108 includes a shaft 178 with a coupler 172 mounted on one end and a pulley 182 mounted on its opposite end. The shaft 178, coupler 172, and pulley 182 rotate simultaneously about axis 206 (see FIG. 5).

The toy aquarium 10 includes drive belts 196 and 198 that couple the drive coupling 188 to drive elements 106 and 108, respectively. As illustrated in FIGS. 5 and 6, drive belt 196 operatively engages pulley 190 and pulley 166. Similarly, drive belt 198 operatively engages pulley 192 and pulley 182. As illustrated in FIG. 5, as the drive coupling 188 rotates along the direction of arrow "A," drive element 106 rotates along the direction of arrow "B" about axis 204 and drive element 108 rotates along the direction of arrow "C" about axis 206. In the illustrated embodiment, axes 204 and 206 are substantially parallel to axis 202.

The coupler 156 of drive element 106 includes an arm 158 that extends perpendicularly from one end of shaft 162. The coupler 156 and shaft 162 are coupled to the pulley 166 by inserting a fastener (not shown) through opening 164 in shaft 162 and opening 168 in pulley 166.

The coupler 172 of drive element 108 includes an arm 174 that extends perpendicularly from one end of the shaft 178. The coupler 172 and shaft 178 are coupled to the pulley 182 by inserting a fastener (not shown) through opening 180 in shaft 178 and the opening 184 in pulley 182.

In the illustrated embodiment, toy character 26 includes a body 151 that resembles a fish. The body 151 includes a front surface 146 and a rear surface 148. In the illustrated embodiment, toy character 26 includes an extension 154 that extends from the rear surface 148.

Similarly, toy character 28 includes a body 153 that resembles a fish. The body 153 includes a front surface 142 and a rear surface 144. The toy character 28 includes an extension 170 that extends from the rear surface 144. Various types of indicia, such as aquatic related indicia, may be formed or located on the front surfaces 142 and 146 of characters 26 and 28.

In the illustrated embodiment, toy character 26 includes a recess 150 formed in its rear surface 148. The recess 150 is located proximate to the outer edge or near the perimeter of the body 151. Similarly, the toy character 28 includes a recess 152 formed in its rear surface 144. The recess 152 is located proximate to the outer edge or near the perimeter of the body 153. Weights 136 and 138 are disposed in recesses 150 and 152, respectively, and may be retained therein by friction or a fastening mechanism such as an adhesive.

As previously discussed, toy characters 26 and 28 are rotatably coupled to drive elements 106 and 108, respectively. The extension 154 of toy character 26 is inserted into an opening 160 formed in arm 158. Similarly, the extension 170 of toy character 28 is inserted into an opening 176 formed in arm 174. The openings 160 and 176 are configured to allow rotation of the extensions 154 and 170 therein.

As drive elements 106 and 108 rotate, toy characters 26 and 28 simultaneously move about the axes 204 and 206, respectively. The movement of toy characters 26 and 28 can be understood with reference to points 207 and 208 on toy characters 26 and 28, respectively, as illustrated in FIG. 5. Points 207 and 208 are disposed on the bottom surfaces of extensions 154 and 170.

As previously discussed, extensions 154 and 170 are rotatably mounted in openings 160 and 176. Rotation of drive element 106 causes point 207 to move in a substantially circular pattern about axis 204. Regardless of the position of arm 158 during operation, point 207 is continuously aligned with the bottom of opening 160 because the weight 136 keeps character 30 in its substantially horizontal configuration. As drive element 106 rotates, arm 158 changes its orientation with respect to axis 204 and the distance between the lowest point of opening 160 and axis 204 changes. The distance is the shortest when arm 158 extends upwardly and the greatest when arm 158 extends downwardly. Rotation of drive element 108 causes point 208 to move in a substantially similar pattern about axis 206.

As toy characters 26 and 28 move, weights 136 and 138 cause toy characters 26 and 28 to maintain their orientations with respect to a reference frame (x, y) (see FIG. 5). The reference frame (x, y) is a fixed frame of reference with respect to the toy aquarium 10. In one embodiment, the horizontal orientation of the toy characters 26 and 28 with respect to the reference frame (x, y) may slightly vary, for example, due to the mechanical frictional forces.

Figure 7:
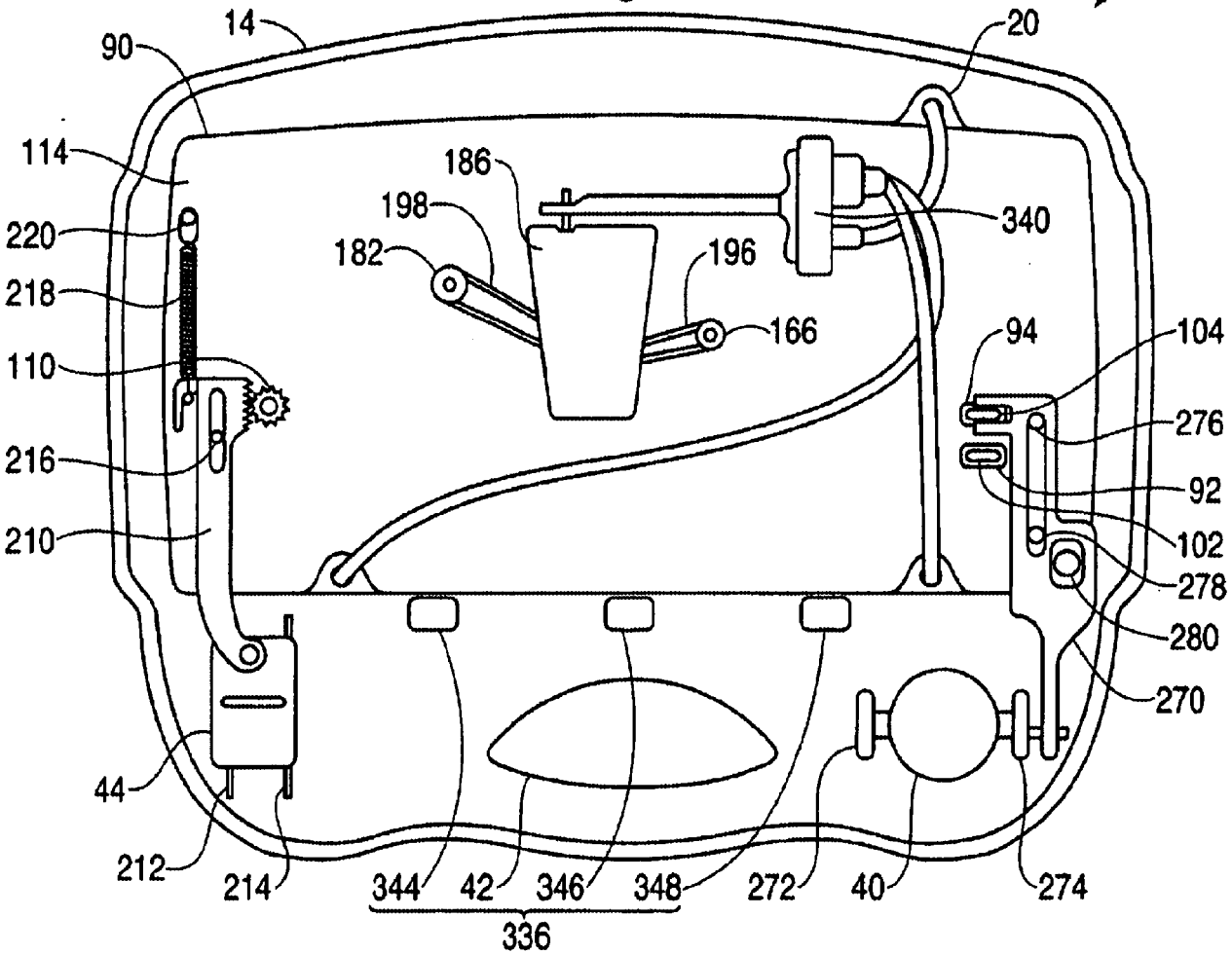
FIG. 7 illustrates a rear view of some of the internal components of the toy aquarium of FIG. 1.
Figure 8:
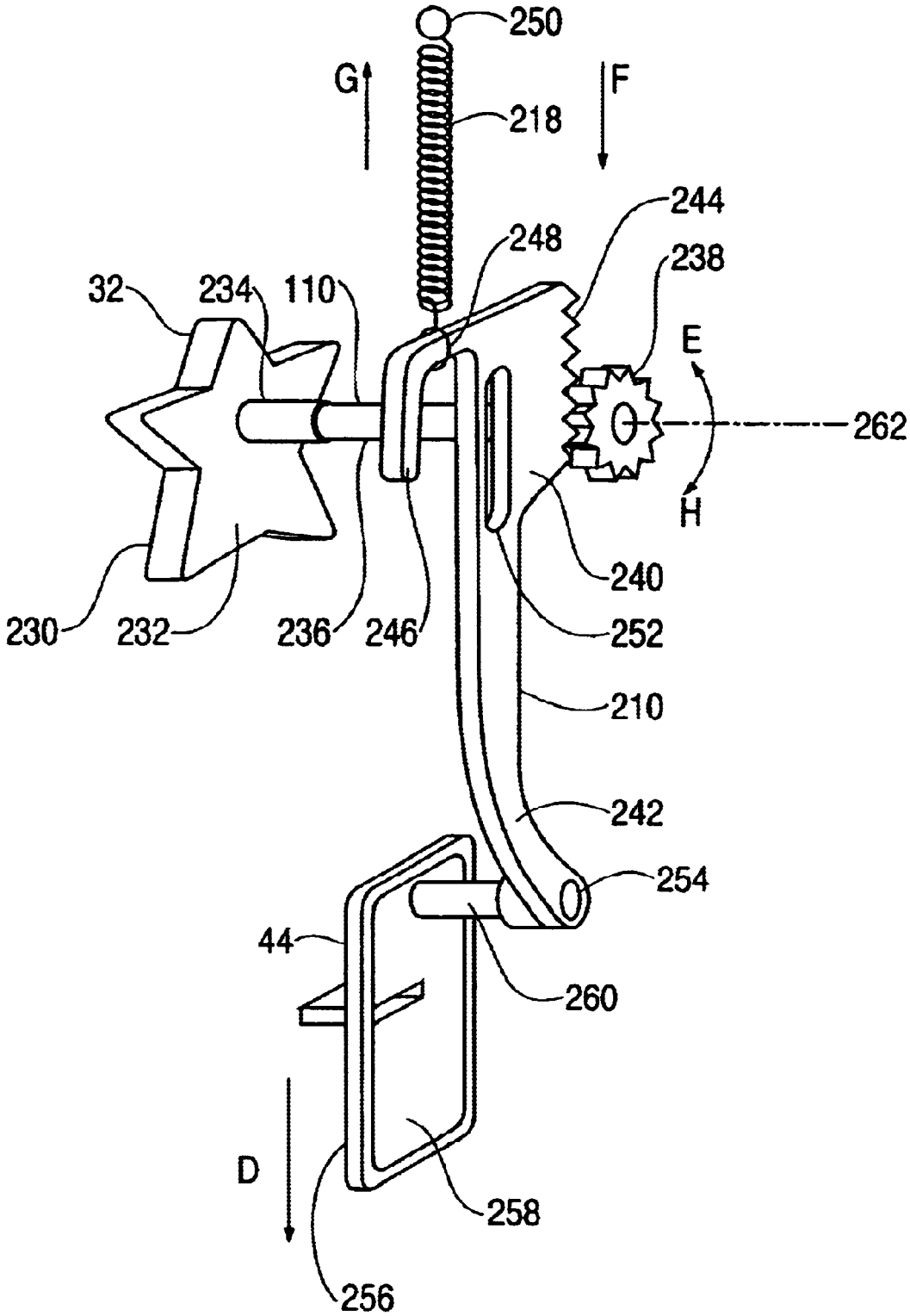
FIG. 8 illustrates an assembled perspective view of the operative relationship of an embodiment of a toy character and an embodiment of an actuator of the toy aquarium of FIG. 1.

Now the movement of toy character 32 is discussed with reference to FIGS. 7 and 8. FIG. 7 is a rear view of some of the internal components of the toy aquarium 10 and FIG. 8 is a rear perspective view of some of the internal components of the toy aquarium 10 related to toy character 32.

In the illustrated embodiment, actuator 44 is slidably coupled to the front portion 14 of the housing 12. The front portion 14 includes rails 212 and 214 (see FIG. 7). The rails 212 and 214 are configured to guide movement of actuator 44 relative to the front portion 14. Actuator 44 includes a front surface 256 and a rear surface 258. An extension 260 projects rearwardly from rear surface 258.

A linkage 210 couples the actuator 44 to drive element 110. Referring to FIG. 8, linkage 210 includes a body portion 240 and an elongate portion 242 extending from one end of the body portion 240. The body portion 240 includes teeth 244, a finger 246, and a slot 252. The elongated portion 242 includes an opening 254 into which the extension 260 of actuator 44 is inserted.

In the illustrated embodiment, a spring 218 is mounted at one end to the linkage 210 and at another end to the plate 90. A first end 248 of the spring 218 includes a loop that is hooked onto finger 246 of linkage 210. A second end 250 of spring 218 includes a loop that is coupled to an extension 220 on the rear surface 114 of plate 90. In the illustrated embodiment, the plate 90 includes a post 216 that extends from rear surface 114. Post 216 is disposed in slot 252 of linkage 210 to guide and limit movement of linkage 210 relative to the plate 90.

In the illustrated embodiment, drive element 110 extends through opening 100 in the plate 90. Drive element 110 includes a shaft 236 and a gear 238 mounted to one end of the shaft 236. In one embodiment, the shaft 236 and the gear 238 may be formed integrally. During operation, gear 238 engages teeth 244 of linkage 210.

Toy character 32 includes a front surface 230 and a rear surface 232. In the illustrated embodiment, the toy character 32 includes an extension 234 that extends from rear surface 232. The extension 234 is coupled to the shaft 236 of drive element 110.

When a user presses downwardly on actuator 44 in the direction of arrow "D" in FIG. 8, linkage 210 moves in the same direction. Movement of linkage 210 moves the teeth 244 downwardly and rotates the gear 238 of drive element 110 and toy character 32 in the direction of arrow "E" about axis 262. Simultaneously, the spring 218 is stretched downwardly in the direction of arrow "F."

When the user releases actuator 44, the spring 218 contracts upwardly along the direction of arrow "G." Movement of the spring 218 in this direction pulls linkage 210 upwardly, thereby moving teeth 244 upwardly as well. As teeth 244 move upwardly, gear 238 and toy character 32 rotate in the direction of arrow "H" about axis 262. When teeth 244 travel a sufficient distance, they disengage from gear 238 and drive element 110 and toy character 32 continue to rotate about axis 262 until the energy that was stored in spring 218 runs out.

Figure 9:
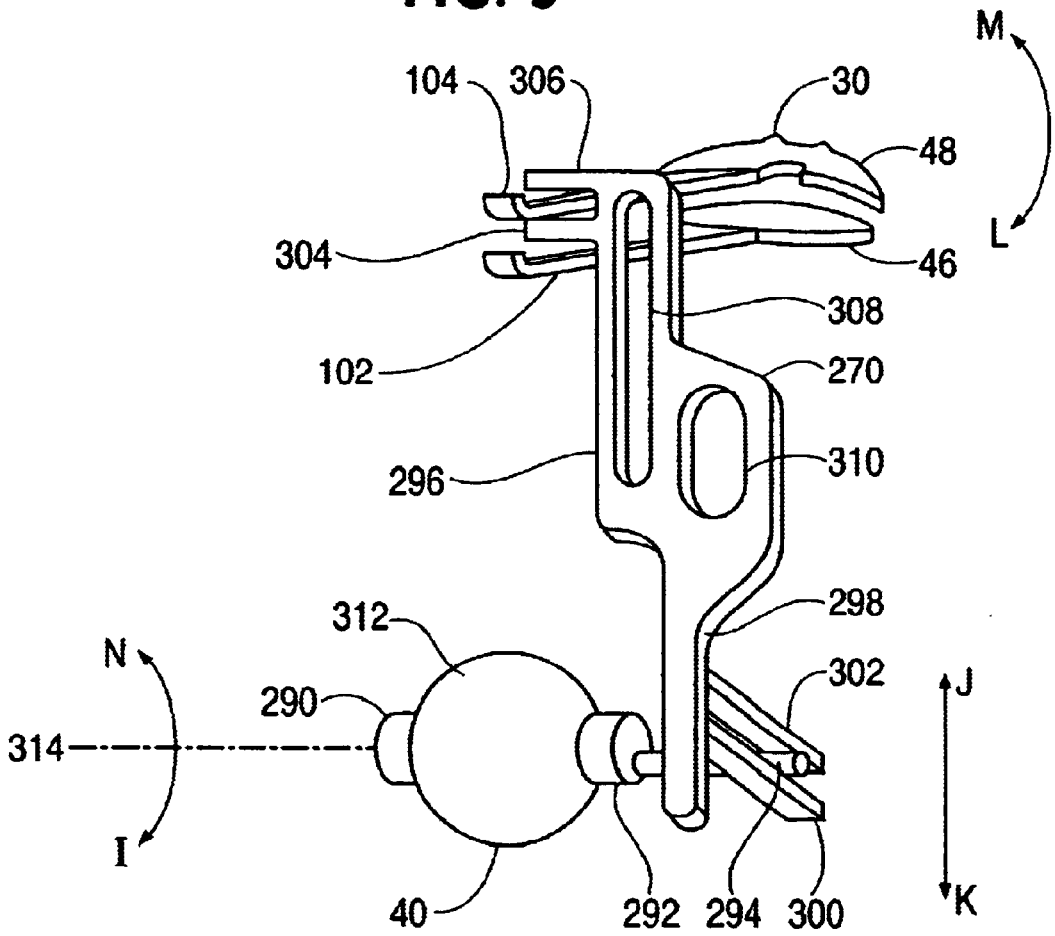
FIG. 9 illustrates an assembled perspective view of the operative relationship of an embodiment of another toy character and an embodiment of another actuator of the toy aquarium of FIG. 1.

Now the movement of toy character 30 is discussed with reference to FIGS. 7 and 9. FIG. 9 is a rear perspective view of some of the internal components of the toy aquarium 10.

In the illustrated embodiment, actuator 40 is rotatably coupled to the front portion 14 of the housing 12. The front portion 14 includes securing members 272 and 274 formed on the rear surface of the front portion 14. The securing members 272 and 274 are configured to support and to guide movement of actuator 40 relative to the front portion 14.

Actuator 40 includes a body 312 and first and second extensions 290 and 292 extending from opposite sides of the body 312. In the illustrated embodiment, body 312 is substantially spherical. The second extension 292 includes a post 294 that extends from the extension 292.

In the illustrated embodiment, a linkage 270 couples actuator 40 to extension 104 of toy character 30. Linkage 270 includes a body portion 296 and an elongate portion 298 extending from one end of the body portion 296. The body portion 296 includes projections 304 and 306 and slots 308 and 310. The elongate portion 298 includes projections 300 and 302. In the illustrated embodiment, projections 300 and 302 are oriented substantially perpendicular to projections 304 and 306. In the illustrated embodiment, post 294 of actuator 40 is inserted between projections 300 and 302.

Plate 90 includes posts 276, 278, and 280 that extend from the rear surface 114 of the plate 90. The posts 276, 278, and 280 are configured to guide movement of linkage 270 relative to the plate 90. Posts 276 and 278 engage slot 308 and post 280 engages slot 310.

Extension 104 of the upper portion 48 of toy character 30 extends through aperture 94 of plate 90. Extension 104 is inserted between projections 304 and 306 of linkage 270. Extension 102 of the lower portion 46 of toy character 30 extends through aperture 92 of plate 90.

Linkage 270 moves in a reciprocatory motion in response to activation of actuator 40. The direction in which linkage 270 moves initially depends on the position of post 294 with respect to the remainder of actuator 40. When a user rotates actuator 40 in the direction of arrow "I" about axis 314 in the position illustrated in FIG. 9, linkage 270 moves in the direction of arrow "J." Movement of linkage 270 in the direction of arrow "J" causes the upper portion 48 of toy character 30 to move in the direction of arrow "L."

As the user continues to rotate actuator 40 in the direction of arrow "I," linkage 270 reverses its direction of movement and moves in the direction of arrow "K." Movement of linkage 270 in the direction of arrow "K" causes the upper portion 48 to move in the direction of arrow "M." As the user continues to rotate actuator 40 along the direction of arrow "I," the upper portion 48 continuously moves through cycles of reciprocatory movement along the directions of arrows "L" and "M."

In the illustrated embodiment, the user can also rotate actuator 40 in the direction of arrow "N." Rotation of actuator 40 in the direction of arrow "N" causes a similar sequence of movements of the upper portion 48 as discussed above.

Referring to FIG. 7, the toy aquarium 10 includes a conventional bubble generating mechanism 340. The bubble generating mechanism 340 is configured to generate bubbles in the container 20 when the container 20 contains a liquid.

As illustrated in FIG. 7, the toy aquarium 10 also includes the light generating mechanism 336. The light generating mechanism 336 is configured to transmit light into the container 20. In the illustrated embodiment, the light generating mechanism 336 includes several light sources 344, 346, and 348 that can be, for example, any conventional light source, such as a light bulb or a light emitting diode. In the illustrated embodiment, each of the light sources 344. 346, and 348 is configured to transmit a colored light into the container 20. In one embodiment, each of the light sources 344, 346, and 348 may include a colored, transparent member in order to transmit a colored light. During operation, the light sources 344, 346, and 348 may be illuminated intermittently or in a particular sequence to create a changing visual appearance.

Now, the overall operation of the toy aquarium 10 is described. In the illustrated embodiment, a user can turn on the toy aquarium 10 by pressing the activation button 42. Once turned on, the toy aquarium 10 can operate in one of several modes depending on the particular operation mode selected by the user via the mode selection switch 56.

In a first mode, the control unit 116 activates the sound generating mechanism and audio outputs are played. In a second mode, the control unit 116 activates both the sound generating mechanism and the light generating mechanism 336. In this mode, audio outputs are played, and light is transmitted into the container 20. In a third mode, the control unit 116 activates the sound generating mechanism, the light generating mechanism 336, the bubble generating mechanism 340, and the drive mechanism 140. In this mode, audio outputs are played, light is transmitted into the container 20, bubbles are generated in the container 20, and toy characters 26 and 28 are moved.

Figure 10:
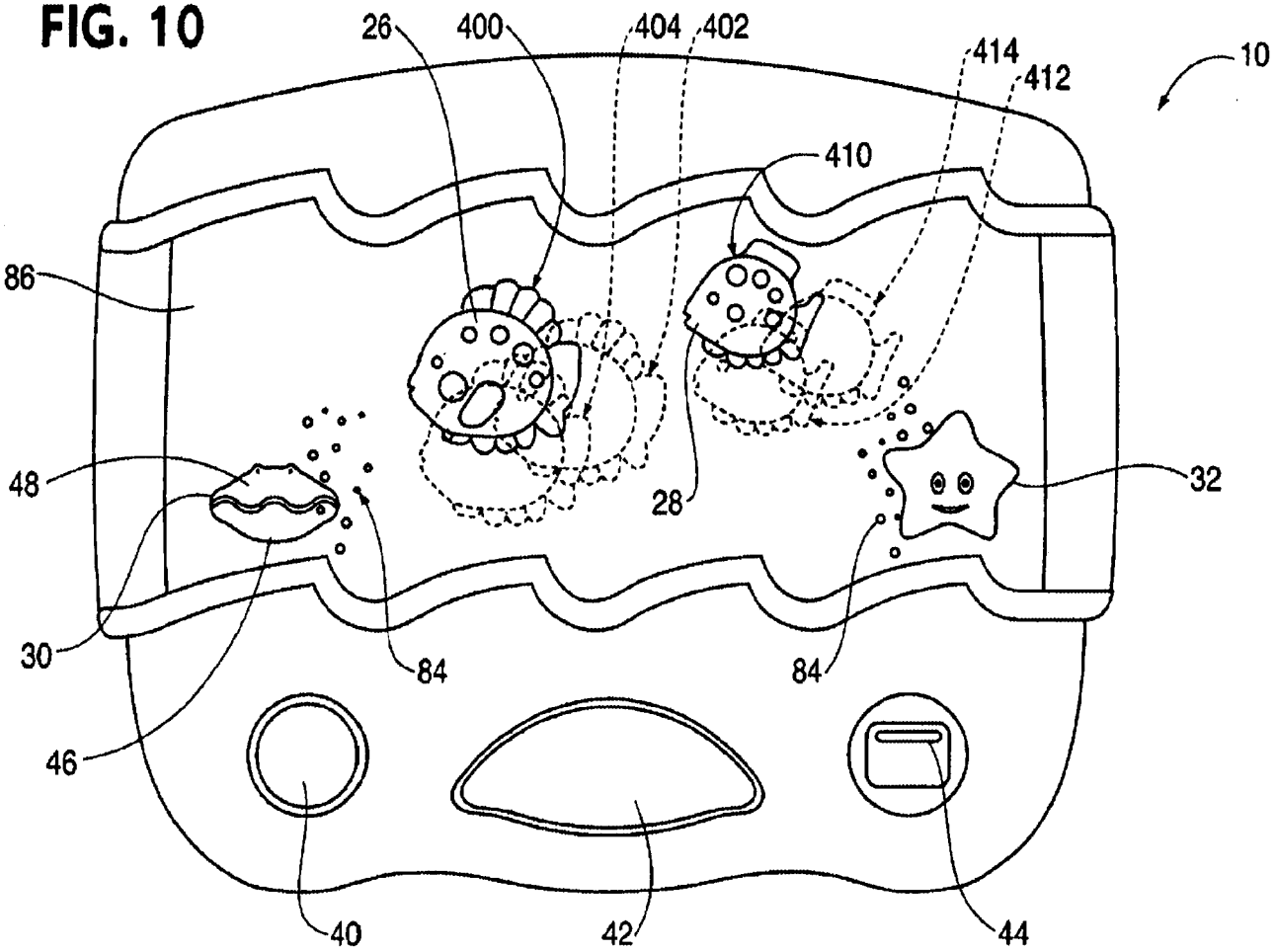
FIG. 10 illustrates several positions of toy characters of the toy aquarium of FIG. 1.

FIG. 10 illustrates several positions of the toy characters 26 and 28 during operation of the toy aquarium 10. During their movement, toy characters 26 and 28 substantially retain their horizontal orientation. While toy characters 26 and 28 are illustrated as facing to the left of the toy aquarium, the characters may have any orientation.

Toy character 26 continuously moves in a substantially circular pattern as represented by a first position 400, a second position 402, and a third position 404. Similarly, toy character 28 continuously moves in a substantially circular pattern as represented by a first position 410, a second position 412, and a third position 414.

In the illustrated embodiment, the toy aquarium 10 operates in a particular operation mode for a predetermined time period, such as ten minutes, after which the toy aquarium 10 automatically turns off. In an alternative embodiment, the toy aquarium 10 may enter into a power down mode after operating for the predetermined time period. Once turned off, the user can turn on the toy aquarium 10 by pressing the activation button 42. In an alternative embodiment, if the user presses the activation button 42 before the toy aquarium 10 turns off, the toy aquarium 10 operates for another predetermined time period before turning off.

The user can select a particular audio output to be played using the audio selection button 58. Successive depressions of the audio selection button 58 result in scrolling through several audio outputs stored in the control unit 116. The stored audio outputs correspond to various music selections and sound effects, such as sound effects related to water. The user can select the volume at which a particular audio output is played by adjusting the volume adjustment dial 60.

The user can rotate actuator 40 to cause the upper portion 48 of toy character 30 to move, thereby providing the appearance of the opening and closing of a clam. The user can also press actuator 44 downwards to cause toy character 32 to move, thereby providing the appearance of a spinning starfish. The user can engage actuators 40 and 44 to move toy characters 30 and 32 when the toy aquarium 10 is turned on or off.

Many alternative embodiments are contemplated in accordance with the present invention. For example, in alternative embodiments, the toy characters 26, 28, 30, and 32 can have any shape, size, or configuration. The toy characters 26, 28, 30, and 32 can include various indicia or representations disposed thereon. In alternative embodiments, one or more of the toy characters 26, 28, 30, and 32 may be disposed within the container 20.

In alternative embodiments, drive elements 106 and 108 and drive coupling 188 can have various shapes, sizes, and configurations. In alternative embodiments, the drive mechanism 140 may be operably coupled to toy characters 26 and 28 via a gear arrangement.

In alternative embodiments, the bubble generating mechanism 340 may be manually operated in order to generate bubbles in the container 20.

In an alternative embodiment, the front portion 14 and the rear portion 16 may be formed integrally. Similarly, the transparent front region 22 and the transparent rear region 24 may be formed integrally.

In an alternative embodiment, the opening 18 of the front portion 14 of the housing 12 may be covered with a transparent sheet or member that is coupled to or formed integrally with the front portion 14.

In an alternative embodiment, the toy aquarium 10 randomly selects and plays an audio output as the audio selection button 58 is pressed.

In an alternative embodiment, the drive mechanism can be coupled to a drive element to move the drive element in a non-rotational path of movement. For example, the drive mechanism can be configured to impart translational or reciprocatory movement to a drive element.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A toy aquarium comprising:

a plurality of walls defining a first compartment, a second compartment, and a third compartment, said second compartment being disposed between said first compartment and said third compartment, said third compartment being configured to contain a liquid;

a drive element, said drive element having a first end and a second end, said first end of said drive element being disposed in said first compartment, said second end of said drive element being disposed in said second compartment;

a drive mechanism disposed in said first compartment, said drive mechanism being coupled to said first end of said drive element and being configured to move said drive element; and a toy character disposed in said second compartment, said toy character being coupled to said second end of said drive element, said toy character being configured to translate with respect to at least one of the plurality of walls when the drive element rotates.

2. The toy aquarium of claim 1, said toy character being rotatably coupled to said second end of said drive element, said toy character including a weight coupled thereto such that said toy character substantially retains its orientation as said drive element rotates.

3. The toy aquarium of claim 1, said drive mechanism being configured to rotate said drive element.

4. The toy aquarium of claim 1, said drive mechanism including a motor, said motor being operably coupled to said first end of said drive element.

5. The toy aquarium of claim 1, said drive element being a first drive element, and said toy character being a first toy character, said toy aquarium further comprising:

a second drive element, said second drive element having a first end and a second end, said first end of said second drive element being disposed in said first compartment, said second end of said second drive element being disposed in said second compartment, said drive mechanism being coupled to said first end of said second drive element, said drive mechanism being configured to rotate said second drive element; and a second toy character disposed in said second compartment, said second toy character being coupled to said second end of said second drive element.

6. The toy aquarium of claim 5, further comprising:

a third toy character disposed in said second compartment; and an actuator, said actuator being operably coupled to said third toy character, said actuator being configured to move said third toy character in response to user engagement of said actuator.

7. A toy aquarium, comprising:

a container, said container being configured to contain a liquid;

a plate, said plate being coupled to said container, said plate including a first side and an opposite second side, said plate being disposed proximate to said container to define a compartment between said container and said first side of said plate;

a toy character disposed in said compartment, said toy character being movably mounted to said plate; and a drive mechanism, said drive mechanism being disposed proximate to said second side of said plate, said drive mechanism being operably coupled to said toy character to impart translational motion to said toy character.

8. The toy aquarium of claim 7, further comprising:

a drive element, said drive element extending through said plate, said drive element having a first end and a second end, said first end of said drive element being coupled to said drive mechanism, said second end of said drive element being coupled to said toy character.

9. The toy aquarium of claim 8, said drive mechanism being configured to rotate said drive element.

10. The toy aquarium of claim 7, further comprising:

a bubble generating mechanism, said bubble generating mechanism being coupled to said container, said bubble generating mechanism being configured to generate bubbles in a liquid in said container.

11. The toy aquarium of claim 7, said container including a transparent wall, said toy aquarium further comprising:

a light generating mechanism, said light generating mechanism being disposed proximate to said transparent wall, said light generating mechanism being configured to transmit light through said transparent wall and into said container.

12. The toy aquarium of claim 7, further comprising:

a housing, said housing including a front portion and a rear portion defining therebetween an interior region, said container, said plate, said toy character, and said drive mechanism being disposed within said interior region, said container being coupled to said housing.

13. The toy aquarium of claim 12, said container including a transparent front region and a transparent rear region, said transparent front region being disposed proximate to said front portion of said housing, said transparent rear region being disposed proximate to said toy character, said front portion of said housing including an opening configured to provide viewing of said toy character through said transparent front region and said transparent rear region.

14. The toy aquarium of claim 12, said toy character being a first toy character, said toy aquarium further comprising:

a second toy character disposed in said compartment; and an actuator, said actuator being coupled to said housing and being operably coupled to said second toy character, said actuator being configured to move said second toy character in response to user engagement of said actuator.

15. The toy aquarium of claim 14, said actuator being a first actuator, said toy aquarium further comprising:

a third toy character disposed in said compartment; and a second actuator, said second actuator being coupled to said housing and being operably coupled to said third toy character, said second actuator being configured to move said third toy character in response to user engagement of said second actuator.

16. A method of using a toy aquarium, the toy aquarium including a plurality of walls defining a first compartment and a second compartment, a drive element having a first end and a second end, a drive mechanism disposed in the first compartment, the drive mechanism being coupled to the first end of the drive element, and a toy character disposed in the second compartment, the toy character being coupled to the second end of the drive element, the method comprising:

imparting motion to the drive element via the drive mechanism, said imparting motion to the drive element including moving a portion of the drive mechanism; and imparting translational motion to the toy character via the drive element, the toy character substantially retaining its orientation as the toy character is moved.

17. The method of claim 16, the drive mechanism including a motor and a drive coupling coupled to the motor, the drive coupling being operably coupled to the drive element, said imparting motion to the drive element including rotating the drive coupling.

18. The method of claim 16, the plurality of walls defining a third compartment therebetween, the third compartment containing a liquid, said method further comprising:

generating bubbles in the liquid contained in the third compartment.

19. The method of claim 16, said imparting motion to the drive element occurs simultaneously with said imparting motion to the toy character.

20. The method of claim 16, said imparting motion to the drive element including imparting rotational motion to the drive element, and said imparting motion to the toy character including imparting rotational motion to the toy character.

* * * * *